US005934330A

United States Patent [19]

Prenzler

[11] Patent Number: 5,934,330

[45] Date of Patent: Aug. 10, 1999

[54] WATER JET CONTROLLER AND FLOW LIMITING DEVICE FOR SANITARY FITTINGS

[76] Inventor: Klaus Prenzler, Winsener Strasse 45, D-29323 Witze, Germany

[21] Appl. No.: 08/507,434

[22] PCT Filed: Mar. 4, 1994

[86] PCT No.: PCT/DE94/00236

§ 371 Date: Mar. 18, 1996

§ 102(e) Date: Mar. 18, 1996

[87] PCT Pub. No.: WO94/20219

PCT Pub. Date: Sep. 15, 1994

[30] Foreign Application Priority Data

Mar. 8, 1993 [DE] Germany ..... PCT/DE/00204

[51] Int. Cl.[6] ..... F15D 1/02

[52] U.S. Cl. ..... 138/43; 138/45; 138/46

[58] Field of Search ..... 138/43, 45, 46

[56] References Cited

U.S. PATENT DOCUMENTS

| | | | |
|---|---|---|---|
| 691,186 | 1/1902 | Schick | 138/43 |
| 2,517,154 | 8/1950 | Wolf | 138/43 |
| 3,120,243 | 2/1964 | Allen et al. | 138/45 |
| 3,431,944 | 3/1969 | Sakuma | 138/43 |
| 3,587,652 | 6/1971 | Remus | 138/45 |
| 4,266,576 | 5/1981 | Bradford | 138/45 |
| 4,383,552 | 5/1983 | Baker | 138/46 |
| 4,424,952 | 1/1984 | Thomson et al. | 138/43 |
| 4,635,751 | 1/1987 | Howell | 138/46 |
| 4,867,198 | 9/1989 | Faust | 138/45 |
| 5,081,847 | 1/1992 | Anderson, Jr. | 138/43 |

*Primary Examiner*—Denise L. Ferensic
*Assistant Examiner*—James F. Hook
*Attorney, Agent, or Firm*—Fulbright & Jaworski LLP

[57] ABSTRACT

The invention is a water flow limiting device that is placed into a housing. The flow device has a baffle plate which has one or more inlet passages and an outlet passage that has a predetermined diameter. The device also has a cylinder plate with one or more drain passages. The cylinder plate is connected to the baffle plate to form a distribution chamber. The distribution chamber receives the water from the outlet passage and empties it through the drain passages. The flow device also has a baffle device that is attached to the cylinder plate and accurately regulates the amount of water flowing from the distribution chamber into the drain passages. The baffle device may be a needle point screw, a rounded screw, a flat screw, or a combination screw and moveable orifice plate.

11 Claims, 5 Drawing Sheets

WATER JET CONTROLLER AND FLOW LIMITING DEVICE FOR SANITARY FITTINGS

TECHNICAL FIELD OF THE INVENTION

The invention relates to accessories for sanitary fittings, specifically to a flow limiting device and water jet controller with replaceable baffle device and barrier or guiding elements.

BACKGROUND OF THE INVENTION

The known water jet controllers and baffle devices are equipped only with one baffle device. An example prior art device is disclosed in CH-A-315 823. This device relates to a mouth piece for mixing exiting fluid with air.

Since consumer awareness continues to develop positively because of increasing energy and water costs and with respect to protecting the environment, the handling of environmental products must be simplified and effective.

Flow limiting devices could be used more frequently if all supply devices in the commercial and private arena could be set simply to a minimally needed amount of water.

In the known flow limiting devices, there is only one accessing baffle point for setting the flow amount.

SUMMARY OF THE INVENTION

The illustration (FIG. 1) shows, in cross section, baffle plate (33), cylinder orifice plate (26), spiral spring (17), and baffle screw (31). By using baffle screw (31), with needle point (38), in the screwed-in state, the water flow can be limited without reducing the diameter of the inlet hole. Further, a precision adjustment can still be performed.

The illustration (FIG. 2) shows, in cross section, housing (19), baffle plate (35), cylinder orifice plate (40), spiral spring (17) and baffle screw (29). The prebaffling is performed by baffle plate (35), inlet hole (5) with selected diameter, and precision baffling with baffle screw (29).

The illustration (FIG. 3) shows, in cross section, baffle plate (35), cylinder orifice plate (40), spiral spring (17), orifice plate (21) and baffle screw (29). The prebaffling is performed by baffle plate (35), inlet hole (5) with selected diameter, and precision baffling with baffle screw (27) which, when actuated, lets the orifice plate move vertically.

The illustration (FIG. 4) shows, in cross section, baffle plate (15), cylinder orifice plate (26), spiral spring (17) and baffle screw (28). The prebaffling is performed by baffle plate (15), inlet hole (12) with selected diameter, and precision baffling with baffle screw (28).

The illustration (FIG. 5) shows, in cross section, baffle plate (18), cylinder orifice plate (26), spiral spring (17), orifice plate (21) and baffle screw (27).

The prebaffling is performed by baffle plate (18), with baffle screw (2), and precision baffling with baffle screw (27) which, when actuated, lets the orifice plate move vertically.

The illustration (FIG. 7) shows, in cross section, baffle plate (34), cylinder orifice plate (25), housing (19) and spiral spring (17). The prebaffling is performed by baffle plate (34), inlet hole (5) with selected diameter, and precision baffling with baffle screw (27).

The illustration (FIG. 8) shows, in cross section, baffle plate (34), cylinder orifice plate (24), housing (19), and spiral spring (17). The prebaffling is performed by baffle plate (34), inlet hole (5) with selected diameter, and precision baffling with baffle screw (30).

The illustration (FIG. 9) shows, in cross section, baffle plate (15), cylinder orifice plate (22), spiral spring (17), spiral spring (7), housing (19), and baffle screw (28). The baffling is performed by baffle plate (15), the inlet hole of selected diameter.

The object of the invention is to adjustably and optimally minimize and meter, by adjustment from the outside, the flow amount at water outlets during use, and to guarantee the lifetime of the flow limiting device according to the inventive flow limiting device for many years. Furthermore, it is another object of the invention to preclude maintenance and cleaning problems and to guarantee unproblematic use in the hygiene field.

Below, the invention is explained in more detail, based on a drawing representing only one embodiment. The illustration (FIG. 7) shows the flow limiting device and water jet controller in diagrammatic representation, and shows housing (19), spiral spring (17), baffle plate (34), cylinder orifice plate (25), and baffle screw (27) in the assembled state.

Water enters by hole (5) and (36) into distribution chamber (3) and flows through holes (6) of cylinder orifice plate (25) and, because of the arrangement of air intake slits (11) of housing (19), air is sucked into hollow space (14) of spiral spring (17) and the water, enriched with air, exits spiral spring (17).

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
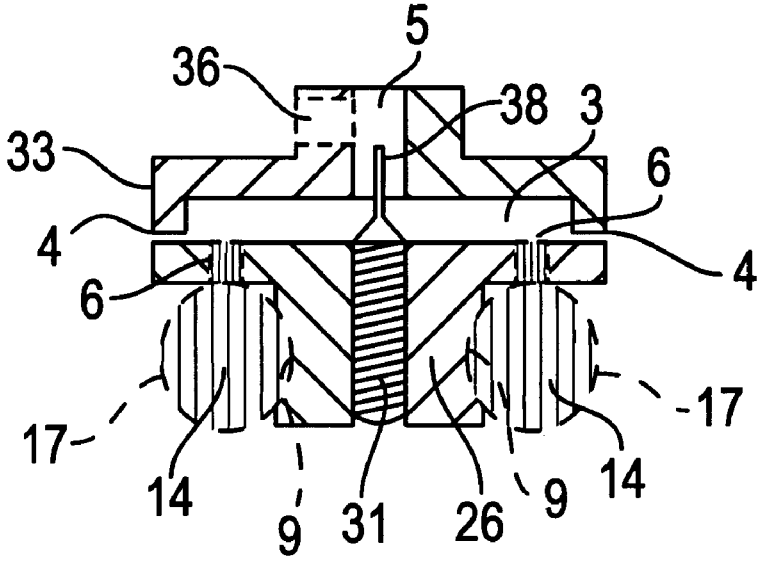
FIG. 1 shows a cross section of the invention with baffle screw (31), baffle plate (33), cylinder orifice plate (26) and spiral spring (17).

The following is a list of identifying reference numerals used to indicate each of the elements depicted in the FIGURES.

(1) baffle shaft
(2) baffle screw-baffle shaft
(3) distribution chamber
(4) supporting edge
(5) inlet hole
(6) hole
(7) spiral spring lying inside spiral spring (17)
(8) intermediate chamber below the orifice plate in the raised state
(9) groove
(10) rim
(11) air intake slits
(12) inlet hole of baffle plate (15)
(13) intermediate chamber between spiral spring (17) and (7)
(14) hollow chamber
(15) baffle plate without baffle shaft
(16) rounded portion of baffle screw (27)
(17) spiral spring
(18) baffle plate with baffle screw
(19) housing
(20) screw head of baffle screw (30)
(21) orifice plate
(22) cylinder orifice plate (stepped)
(23) cylinder orifice plate, stepped with internal thread
(24) cylinder orifice plate with countersinking for screw head (20) of baffle screw (30)
(25) cylinder orifice plate with internal thread
(26) cylinder orifice plate grooved with internal thread
(27) baffle screw (27)
(28) baffle screw with point (37)
(29) baffle screw, flat
(30) baffle screw with head
(31) baffle screw with needle point
(32) spiral spring, lying inside
(33) baffle plate with side hole (36)
(34) baffle plate with side hole (36) that goes all the way through
(35) baffle plate without side hole
(36) side hole of baffle plate (33)
(37) baffle screw tip of baffle screw (31)
(38) needle point of baffle screw (31)
(39) holes of orifice plate (21)
(40) cylinder orifice plate with inside thread
(41) housing With the invention, the two independent baffle devices are used to lower the noise level and to make it possible for the flow limiting device to be able to be used with all water amounts, e.g., in the range of 0.5 to 20 l/h.

The baffle devices can be modified with a few maneuvers into different variants. In this way, all types of fittings can be optimally configured for the respective requirements.

FIG. 1 shows, in cross section, in particular, a baffle plate 33; a cylinder orifice plate 26, a spiral spring 17, i.e., a closed, annular coil spring, and a baffle screw 31. By using baffle screw 31 with needle point 38 in the screwed-in state, the water flow can be limited without reducing the diameter of the inlet hole. Further, a precision adjustment can still be performed.

Figure 2:
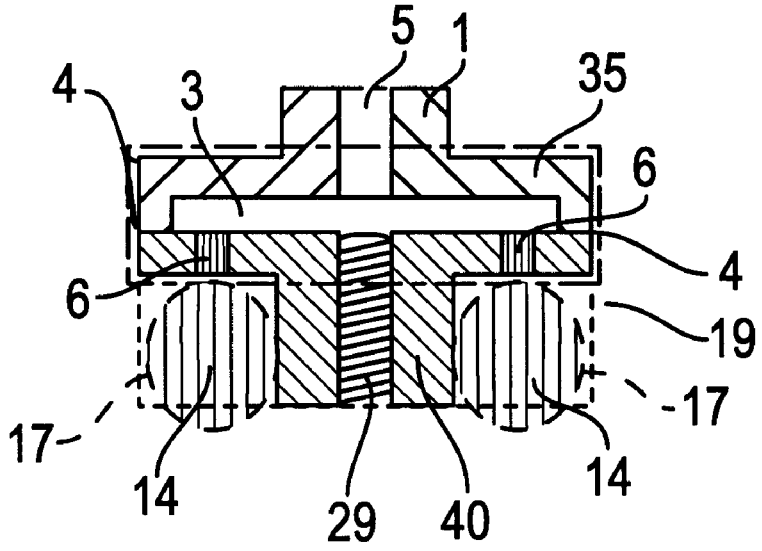
FIG. 2 shows a cross section of the invention with baffle plate (35), cylinder orifice plate (40) and spiral spring (17).

FIG. 2 shows, in cross section, in particular housing 19, a baffle plate 35, a cylinder orifice plate 40, spiral spring 17 and baffle screw 29. The prebaffling is performed by baffle plate 35 and an inlet hole 5 with selected diameter, and a precision baffling is performed by baffle screw 29.

Figure 3:
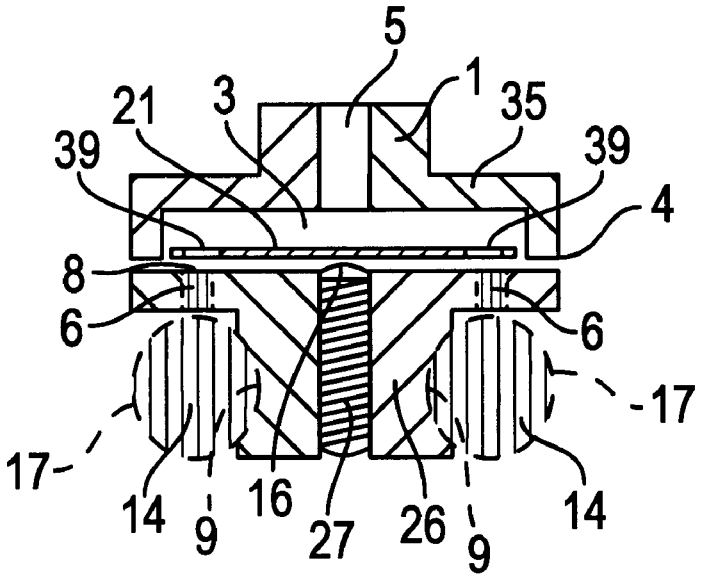
FIG. 3 shows a cross section of the invention with baffle plate (35), cylinder orifice plate (26), baffle screw (27), orifice plate (21), and spiral spring (17).

FIG. 3 shows, in cross section, in particular, baffle plate 35, a cylinder orifice plate 40, spiral spring 17, an orifice plate 21 and baffle screw 29. The prebaffling is performed by baffle plate 35 and inlet hole 5 with selected diameter, and a precision baffling is performed by baffle screw 27, which moves the orifice plate vertically when actuated.

Figure 4:
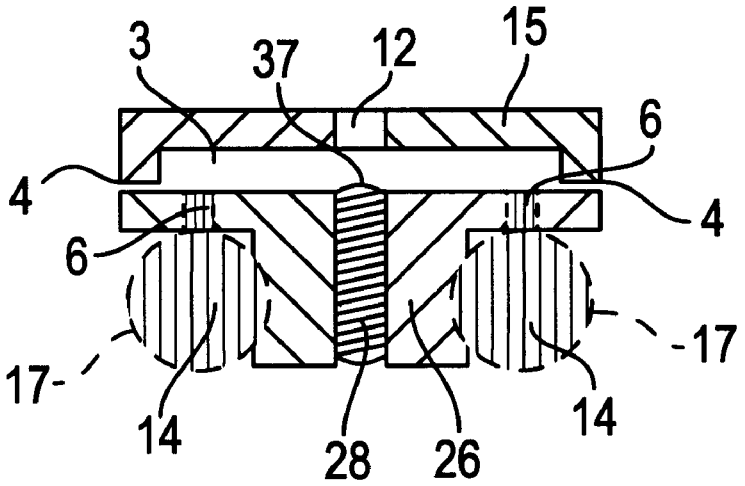
FIG. 4 shows a cross section of the invention with baffle plate (15), cylinder orifice plate (25), baffle screw (28), and spiral spring (17).

FIG. 4 show, in cross section, in particular, a bale plate 15, a cylinder orifice plate 26, spiral spring 17 and baffle screw 28. The prebaffling is performed here by baffle plate 15 and inlet hole 12 with selected diameter, and the precision baffling is performed by baffle screw 28.

Figure 5:
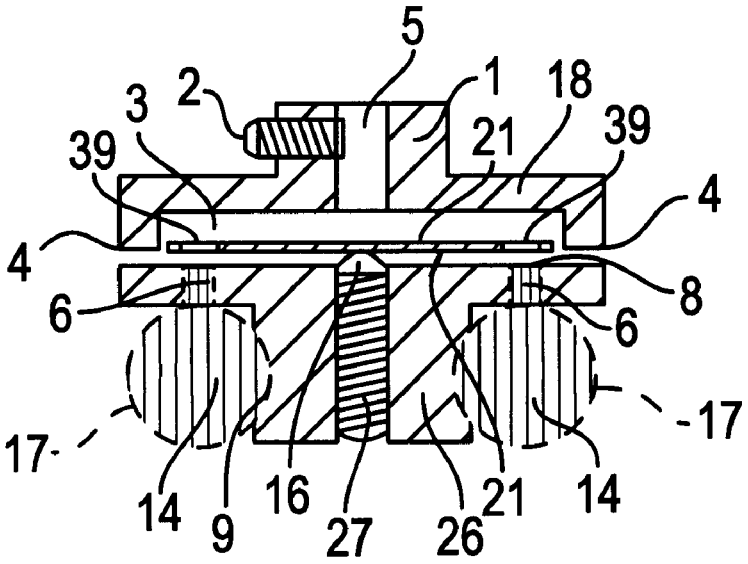
FIG. 5 shows a cross section of the invention with baffle plate (18), cylinder orifice plate (26), baffle screw(27), baffle screw (2), orifice plate (21), and spiral spring (17).

FIG. 5 shows, in cross section, in particular, a baffle plate 18, a cylinder orifice plate 26, spiral spring 17, orifice plate 21 and a baffle screw 27. The prebaffling is performed by baffle plate 18 and baffle screw 2, and the precision baffling is performed by baffle screw 27, which moves the orifice plate vertically when actuated.

Figure 6:
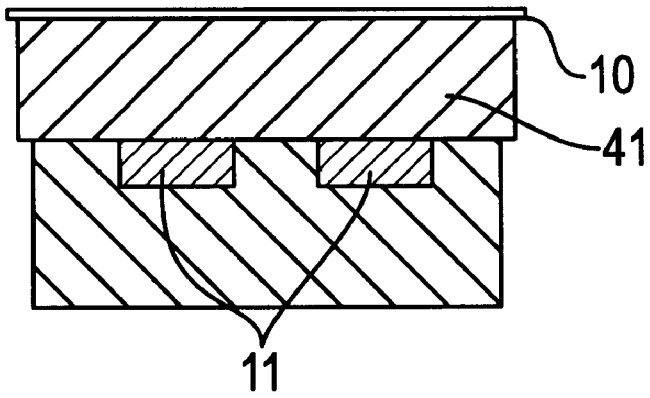
FIG. 6 shows the housing (19).

FIG. 6 shows the housing 41 with rim 10 and air intake slits 11.

Figure 7:
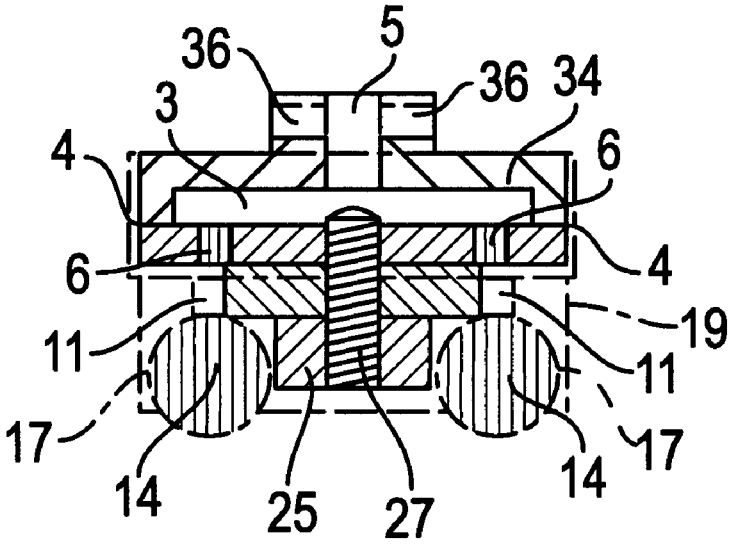
FIG. 7 shows a cross section of the invention with baffle plate (34), cylinder orifice plate (25), baffle screw (27), spiral spring (17), and housing (19).

FIG. 7 shows the flow limiting device and water jet controller in a diagrammatic representation. FIG. 7 shows housing 19, spiral spring 17, a baffle plate 34, a cylinder orifice plate 25 and baffle screw 27 in the assembled state. The water enters by hole 5 and 36 into distribution chamber 3 and flows through the holes in the cylinder orifice plate and, because of the arrangement of air intake slits 11 on housing 19, air is sucked into the hollow space of the spiral spring and the water, enriched with air, exits from spiral spring 17. The prebaffling is performed by baffle plate 34 and inlet hole 5 with selected diameter, and the precision baffling is performed with the aid of baffle screw 27.

Figure 8:
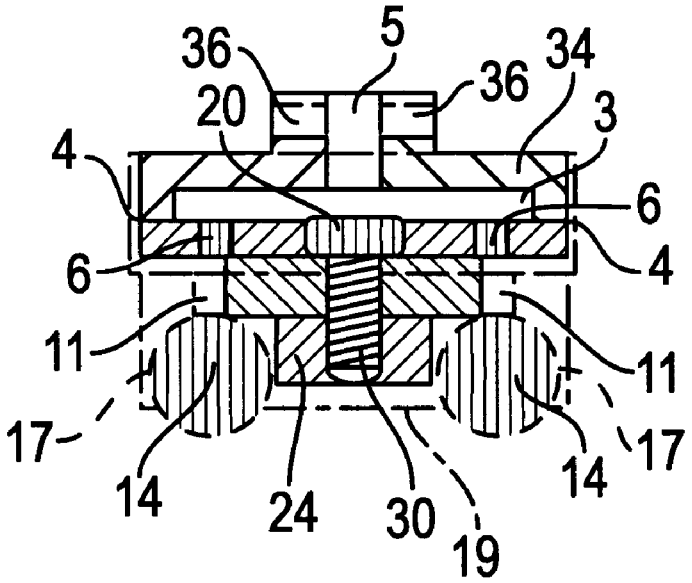
FIG. 8 shows a cross section of the invention with baffle plate (34), cylinder orifice plate (24), baffle screw (30), and spiral spring (17).

FIG. 8 shows, in cross section, in particular, baffle plate 34, a cylinder orifice plate 24, housing 19 and spiral spring 17. The prebaffling is performed by baffle plate 34 and inlet hole 5 with selected diameter, and the precision baffling is performed with the aid of baffle screw 30.

Figure 9:
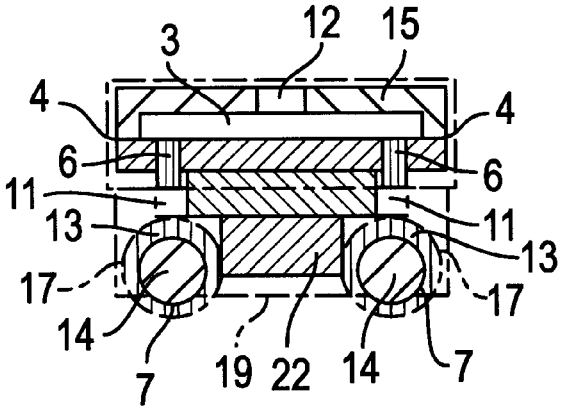
FIG. 9 shows a cross section of the invention with baffle plate (15), cylinder orifice plate (22), spiral spring (17), spiral spring (7), and housing (19).

FIG. 9 shows, in cross section, in particular, baffle plate 15, a cylinder orifice plate 22, spiral spring 17, a spiral spring 7, housing 19 and baffle screw 28. The baffling is performed by baffle plate 15 and the inlet hole with selected diameter.

Figure 10:
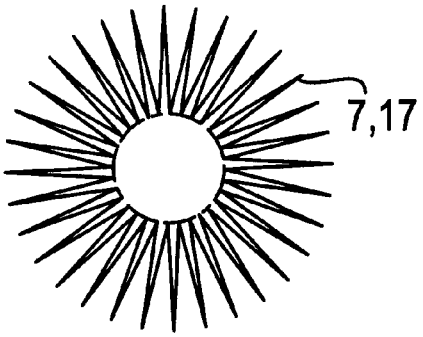
FIG. 10 shows the spiral spring (17) and (7).

FIG. 10 shows spiral spring 7 lying inside spiral spring 17.

Figure 11:
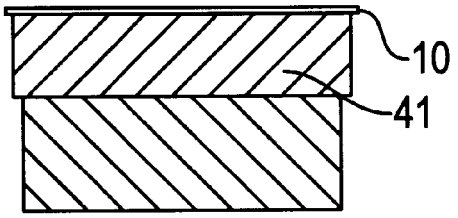
FIG. 11 shows the housing (41) without air intake slits.

FIG. 11 shows the housing 41 with rim 10 without the air intake slits.

Various baffle screws or spiral springs (closed annular coil springs) are used for the water jet shape. The insertion of a second spiral spring 7 into spiral spring 17 reduces the flow velocity. When orifice plate 21 is installed in distribution chamber 3 with baffle screws 27, 28, or 29, the orifice plate is constantly moved when flow goes through it and thus it keeps the distribution chamber free of dirt and lime deposits.

What is claimed is:

1. A flow limiting device for attachment to sanitary fittings and water outlets, for placement in a housing for dividing a flow of water, comprising:

a baffle plate with a passage opening;

a cylinder orifice plate with at least one through-hole, said cylinder orifice plate coupled to said baffle plate;

a distribution chamber formed between said baffle plate and said cylinder orifice plate, said distribution chamber receiving the flow of water from said passage opening and emptying the flow of water through said at least one through-hole;

a baffle device contained within said cylinder orifice plate, for precision baffling of the flow of water; and wherein said baffle device is externally adjustable.

2. The flow limiting device of claim 1, wherein said baffle plate further includes a side hole for emptying into said passage opening.

3. The flow limiting device of claim 1, further comprising a housing including a plurality of air intake openings for drawing in air for mixing with the flow of water.

4. The flow limiting device of claim 1, further comprising:

a first spiral spring;

wherein said cylinder orifice plate includes a neck;

wherein said first spiral spring is disposed around said neck for receiving the flow of water from said through-hole.

5. The flow limiting device of claim 4, further comprising a second spiral spring disposed within said first spiral spring.

6. The flow limiting device of claim 1, wherein said cylinder orifice plate further includes a central taphole placed vertical to said baffle plate.

7. The flow limiting device of claim 6, wherein said baffle device includes a baffle screw disposed within said taphole and including a needle point extending towards said passage opening.

8. The flow limiting device of claim 6, wherein said baffle device includes a baffle screw disposed within said taphole and including a front end facing said passage opening, said front end having a shape selected from:

a pointed end;

a rounded end; and a flat end.

9. The flow limiting device of claim 8, further comprising:

an orifice plate for baffling the flow of water at said passage opening;

wherein said orifice plate is centered in said distribution chamber;

wherein said orifice plate is adjustable by said baffle screw.

10. The flow limiting device of claim 6, wherein said baffle device includes a baffle screw with a diameter and disposed within said taphole, said baffle screw including a molded screw head with a diameter larger than said diameter of said baffle screw.

11. The flow limiting device of claim 10, wherein said cylinder orifice plate is shaped to receive a countersunk screw head.

* * * * *